US010236628B2

(12) United States Patent
Motohashi

(10) Patent No.: US 10,236,628 B2
(45) Date of Patent: Mar. 19, 2019

(54) CONNECTOR

(71) Applicant: Molex, LLC, Lisle, IL (US)

(72) Inventor: Nobumasa Motohashi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/839,078

(22) Filed: Dec. 12, 2017

(65) Prior Publication Data

US 2018/0212360 A1 Jul. 26, 2018

(30) Foreign Application Priority Data

Jan. 24, 2017 (JP) ..... 2017-009947

(51) Int. Cl.

| | |
|---|---|
| ***H01R 9/03*** | (2006.01) |
| ***H01R 12/70*** | (2011.01) |
| ***H01R 12/71*** | (2011.01) |
| ***H01R 12/72*** | (2011.01) |
| ***H01R 13/447*** | (2006.01) |
| ***H01R 13/506*** | (2006.01) |
| ***H01R 13/627*** | (2006.01) |
| ***H01R 13/633*** | (2006.01) |
| ***H01R 13/652*** | (2006.01) |
| ***H01R 13/6581*** | (2011.01) |
| ***H01R 13/6583*** | (2011.01) |
| ***H01R 13/6585*** | (2011.01) |

(52) U.S. Cl.

CPC ..... *H01R 13/6275* (2013.01); *H01R 12/716* (2013.01); *H01R 13/447* (2013.01); *H01R 13/506* (2013.01); *H01R 13/633* (2013.01); *H01R 13/652* (2013.01); *H01R 13/6581* (2013.01); *H01R 13/6583* (2013.01); *H01R 13/6585* (2013.01); *H01R 9/032* (2013.01); *H01R 12/7064* (2013.01); *H01R 12/727* (2013.01)

(58) Field of Classification Search

CPC ..... H01R 13/6271–13/6273; H01R 13/6581–13/6597; H01R 13/6275; H01R 13/652; H01R 13/447; H01R 13/506; H01R 13/633; H01R 12/716; H01R 12/727; H01R 12/7064; H01R 9/032

USPC ..... 439/357, 358, 353, 607.01–607.58

See application file for complete search history.

(56) References Cited

U.S. PATENT DOCUMENTS

| | | | | |
|---|---|---|---|---|
| 5,660,558 A * | 8/1997 | Osanai | H01R 13/508 | 439/353 |
| 6,250,942 B1 * | 6/2001 | Lemke | H01R 13/6272 | 439/352 |
| 6,257,914 B1 * | 7/2001 | Comerci | H01R 13/6273 | 439/357 |

(Continued)

FOREIGN PATENT DOCUMENTS

| | | |
|---|---|---|
| JP | 2003-157934 A | 5/2003 |
| JP | 2011-086495 A | 4/2011 |

*Primary Examiner* — Gary F Paumen

(74) *Attorney, Agent, or Firm* — Molex, LLC

(57) ABSTRACT

A connector is provided which includes a housing, a terminal installed in the housing, and a shell covering at least a portion of the housing. A top plate part of the shell includes a cantilevered latch member, which is a plate spring shaped single latch member formed by cutting and raising the central part in the width direction of the top plate part. The latch member includes a pair of latch claws formed by folding both the right and left ends of the latch member.

19 Claims, 11 Drawing Sheets

(56) References Cited

U.S. PATENT DOCUMENTS

| | | | | |
|---|---|---|---|---|
| 6,358,088 | B1 | 3/2002 | Nishio et al. | |
| 6,902,432 | B2 * | 6/2005 | Morikawa | H01R 13/6275 439/607.41 |
| 7,165,989 | B2 | 1/2007 | Huang et al. | |
| 7,591,664 | B2 | 9/2009 | Nomiyama et al. | |
| 7,654,850 | B2 | 2/2010 | Shimizu | |
| 7,909,632 | B2 * | 3/2011 | Wu | H01R 9/03 439/353 |
| 8,439,708 | B2 | 5/2013 | Colantuono et al. | |
| 8,475,198 | B2 | 7/2013 | Wu | |
| 8,480,432 | B2 * | 7/2013 | Wu | H01R 13/5812 439/353 |
| 9,039,457 | B2 * | 5/2015 | Zhang | H01R 13/6275 439/357 |
| 9,397,442 | B2 * | 7/2016 | Sutter | H01R 24/62 |
| 9,590,355 | B2 | 3/2017 | Kawamura et al. | |
| 2003/0157836 | A1 * | 8/2003 | Morikawa | H01R 13/6275 439/607.41 |
| 2008/0153340 | A1 * | 6/2008 | Shen | H01R 13/5045 439/345 |
| 2008/0176441 | A1 * | 7/2008 | Shen | H01R 13/6273 439/352 |
| 2010/0285683 | A1 * | 11/2010 | Zhang | H01R 13/6275 439/357 |
| 2012/0252253 | A1 * | 10/2012 | Yu | H01R 13/02 439/345 |

* cited by examiner

CONNECTOR

RELATED APPLICATIONS

This application claims priority to Japanese Application No. 2017-009947, filed Jan. 24, 2017, which is incorporated herein by reference in its entirety.

TECHNICAL FIELD

The present disclosure relates to a connector.

BACKGROUND ART

Conventionally, miniature, low profile connectors to be connected to substrates such as printed circuit boards in which electrical equipment, electronic equipment, etc. including wires such as cables have been widely used. One problem concerning such connectors is that these connectors easily come off or release connected mating connectors. Therefore, a latch connector including a latch mechanism has been proposed (see, for example, Patent Document 1).

FIG. 11 is a view illustrating a conventional latch connector.

In the figure, 811 is a housing of a latch connector connected to the tip of a cable 861 and is made of an insulating resin material. Note that a boot 864 for relaxing the stress added to the cable 861 on the portion connecting the housing 811 is attached on the outer periphery in the vicinity of the tip of the cable 861.

Additionally, a rectangular cylindrical shell 871 made of a metal plate protrudes forward from the tip of the housing 811, while multiple terminals 851 electrically connected to mating terminals (not illustrated), as well as a terminal supporting part 815 made of an insulating resin material for the supporting terminals 851, are provided in the rectangular opening of the shell 871. Multiple wires contained in the cable 861 are soldered to the multiple terminals 851.

Moreover, right and left notched parts 873 are formed on the top plate of the shell 871, with a latch member 881 housed inside each notched part 873. Each latch member 881 is a cantilevered elastic member made of a long narrow metal plate stretching in the anteroposterior direction, with a latch claw 882 protruding upward formed on the tip thereof, that is, the free end thereof, and the base end thereof fixed in the housing 811.

In contrast, a notched part 814 is formed in the center of a top plate part 812 of the housing 811, with a latch release button 821 housed inside the notched part 814. The latch release button 821 is a cantilevered elastic member made of a resin material stretching in the anteroposterior direction, with the base end thereof integrally connected to the top plate part 812 and mostly protruding above the top plate part 812. Moreover, the tip, that is, the free end of the latch release button 821 is disposed between the tip and the base end of the right and left latch members 881, as well as just above the portion adjacent to the base end.

Because each latch member 881 includes spring properties and is always flush with the top plate of the shell 871, the latch claw 882 constantly protrudes above the top plate of the shell 871. Therefore, for the case in which the latch connector and a mating connector are mated together, when the shell 871 is inserted into the insertion opening of the mating connector (not illustrated), the latch claw 882 enters a locking hole formed on the top plate of the insertion opening of the mating connector so as to be locked. As a result, the shell 871 of the latch connector is latched by the insertion opening of the mating connector and prevented from being separated from the insertion opening.

Moreover, for the case in which the mating between the latch connector and the mating connector is released to remove the latch connector, an operator presses down the latch release button 821 protruding above the top plate part 812 of the housing 811 by finger. Thereupon, the tip of the latch release button 821 presses down the portion adjacent to the base end of the right and left latch members 881, causing the latch claw 882 at the tip of each latch member 881 to be displaced downward and come off the locking hole formed on the top plate of the insertion opening of the mating connector. As a result, the locking state between the latch claw 882 and the locking hole is released and the latch between the shell 871 of the latch connector and the insertion opening of the mating connector is released, allowing the shell 871 to come off the insertion opening of the mating connector.

Patent Document 1: Japanese Unexamined Patent Application Publication No. 2011-086495

SUMMARY

Unfortunately, because in conventional latch connectors, the long narrow plate latch member 881 is provided on each of the right and left of a top plate of the shell 871, the strength of each latch member 881 is reduced. Therefore, for example, for the case in which an operator, etc. mistakenly has his/her foot caught in the cable 861 with the latch connector mating with a mating connector, thereby adding great tensile strength to the latch connector, the latch member 881 is deformed to release the latch and release the mating between the latch connector and the mating connector.

In order to prevent such a situation, the dimensions (plate thickness, width, etc.) of the latch member 881 must be increased to improve the strength of the latch member 881; however, under the recent environment of the ongoing miniaturization of electrical equipment, electronic equipment, etc., increasing the dimensions of the latch member 881, which leads to the enlargement of the latch connector, is difficult.

Here, in order to resolve the conventional problem, an object is to provide a connector that can increase latching strength without enlarging the dimensions such that even when unexpected external force is added, the latch is not released and the mating state with the mating connector can be assuredly maintained.

In order to do so, a connector includes: a housing; a terminal installed in the housing; and a shell covering at least a portion of the housing, wherein a top plate part of the shell includes a cantilevered latch member, which is a plate spring shaped single latch member formed by cutting and raising the central part in the width direction of the top plate part, and the latch member includes a pair of latch claws formed by folding both the right and left ends of the latch member.

Further, in another connector, the latch member includes: a base end integrally connected to the top plate part; a free end disposed behind the base end; and a wide claw supporting plate disposed between the base end and the free end, wherein the latch claw is formed on both the right and left ends of the claw supporting plate.

Further, in still another connector, the latch member includes: a base end integrally connected to the top plate part; a front coupling plate connected to the base end and inclined so as to descend as the front coupling plate travels backward; and a claw supporting plate connected to the front coupling plate, wherein the latch claw is formed on both the right and left ends of the claw supporting plate, wherein the claw supporting plate is inclined so as to descend as the claw supporting plate travels forward, and the claw supporting plate is connected to the front coupling plate in a downward protrusion protruding downward, and the housing includes a latch member housing recess formed in the portion opposite the latch member, a displacement preventing protrusion protruding upward is formed on the bottom face of the latch member housing recess, and the displacement preventing protrusion limits the downward displacement of the downward protrusion.

Further, in still another connector, the connector further includes a cover housing covering at least a portion of the top plate part of the shell, wherein the cover housing has a free end that can be displaced in the vertical direction and includes a latch operating part disposed just above the free end of the latch member, and the periphery of the latch operating part is surrounded by a frame part and does not protrude above the upper end edge of the frame part.

Further, in still another connector, the connector further includes a mating part mating with a mating connector, wherein the latch claw is disposed on the mating part, wherein, when mating with the mating connector is completed, the latch claw enters a locking hole formed in a mating shell of the mating connector so as to be locked, wherein, when force to release the mating without carrying out the operation of displacing downward the free end is applied to the mating part, the downward protrusion abuts the displacement preventing protrusion so as to limit the downward displacement, thereby preventing the locking between the latch claw and the locking hole from being released.

According to the present disclosure, latching strength can be increased without enlarging the dimensions such that even when unexpected external force is added, the latch is not released and the mating state with the mating connector can be assuredly maintained.

BRIEF DESCRIPTION OF THE DRAWINGS

FIGS. 3A and 3B are two surface views illustrating the state prior to mating the wire connector and the substrate connector according to the present embodiment, wherein FIG. 3A is a plan view, and FIG. 3B is a side view.

FIGS. 8A and 8B are longitudinal cross-sectional views illustrating the state of forcibly extracting the wire connector from the substrate connector according to the present embodiment, wherein FIG. 8A is a longitudinal cross-sectional view corresponding to the arrow cross-section along line A-A in FIG. 3A, and FIG. 8B is an enlarged view of portion B of FIG. 8A.

DETAILED DESCRIPTION OF THE PREFERRED EMBODIMENTS

Embodiments will be described in detail below with reference to the drawings.

Figure 1:
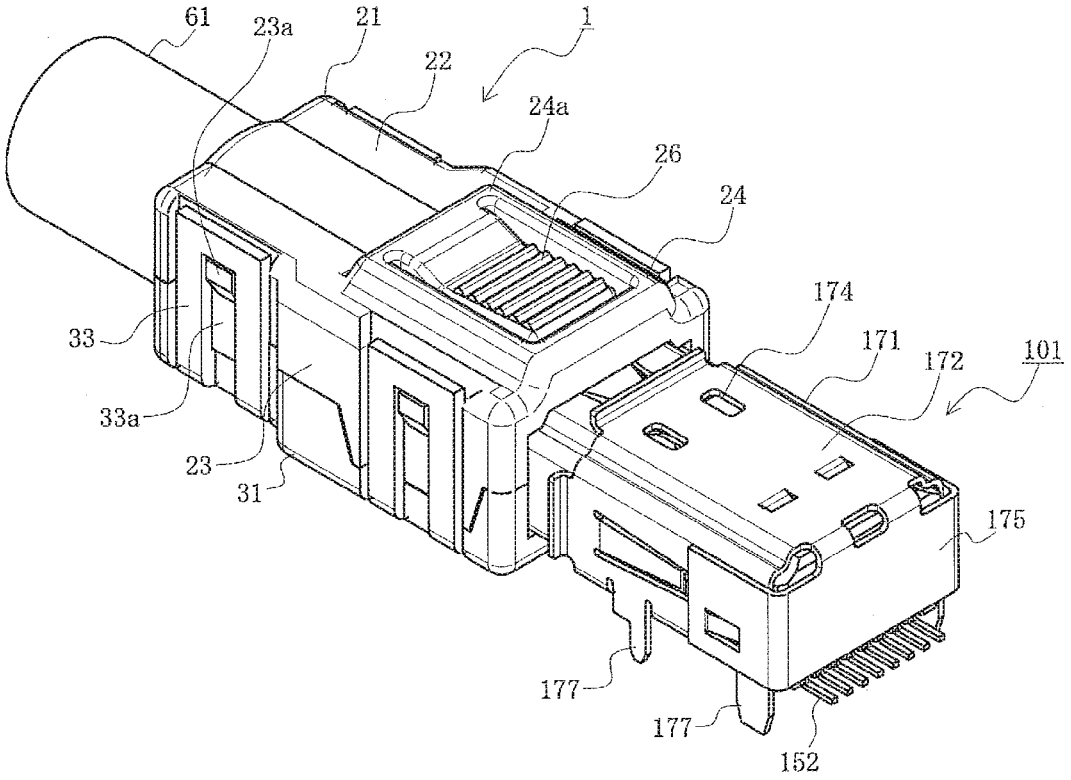
FIG. 1 is a perspective view illustrating the halfway state of mating a wire connector and a substrate connector according to the present embodiment.
Figure 2:
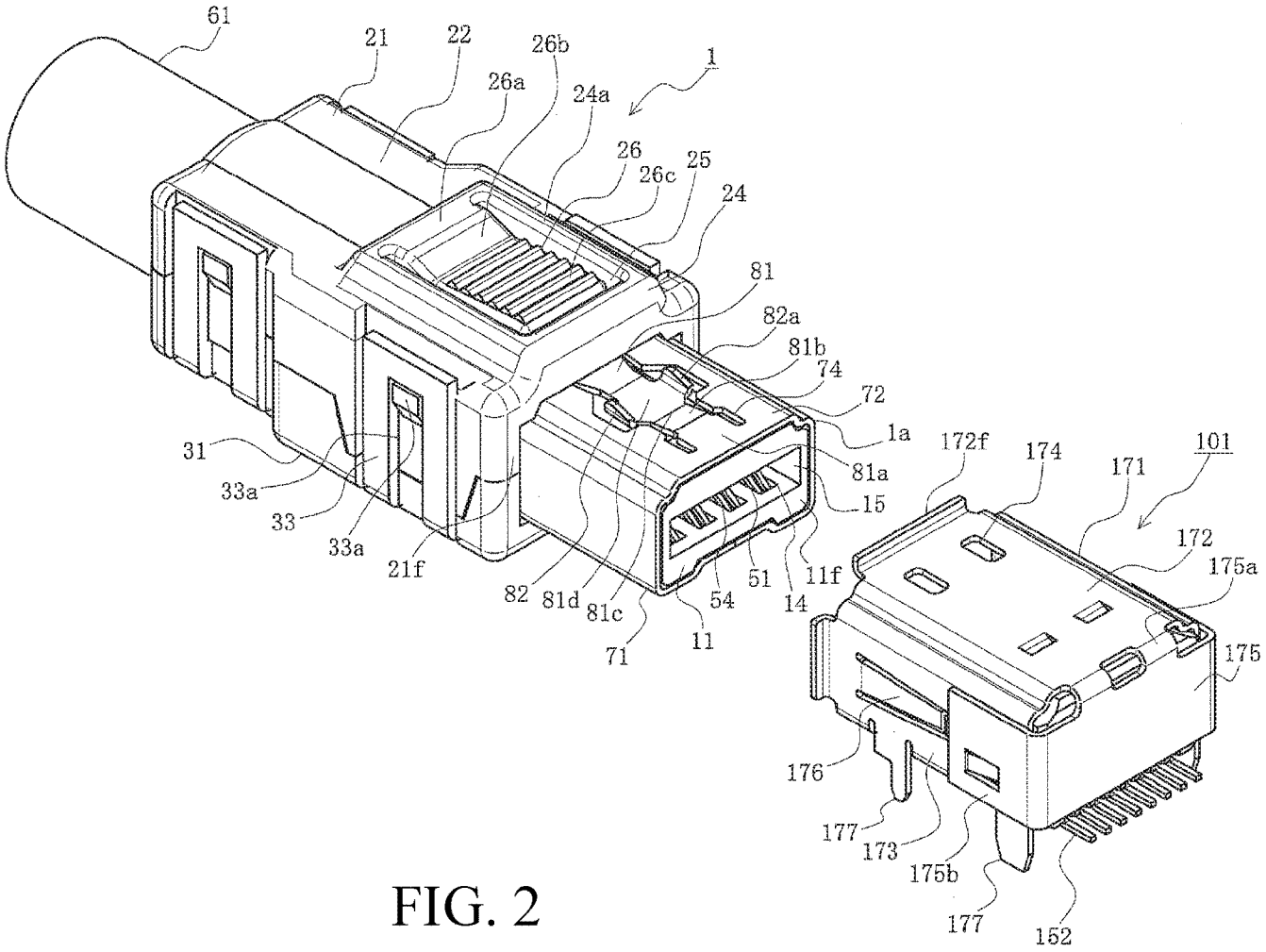
FIG. 2 is a perspective view illustrating the state prior to mating the wire connector and the substrate connector according to the present embodiment.
Figure 3A:
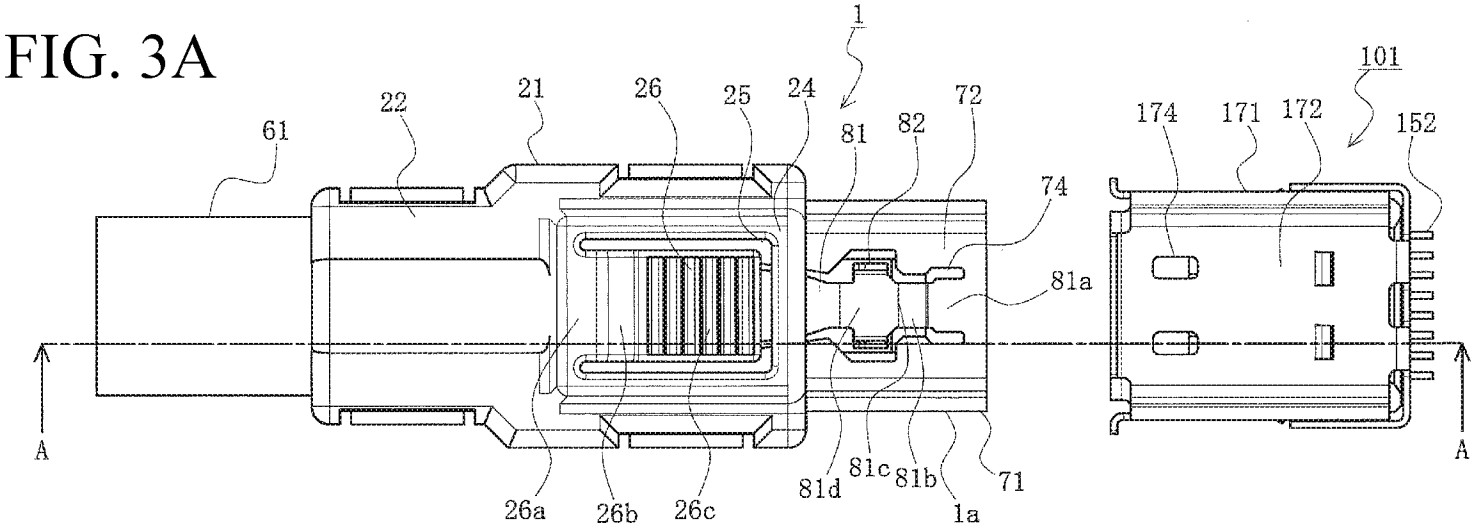
Figure 3B:
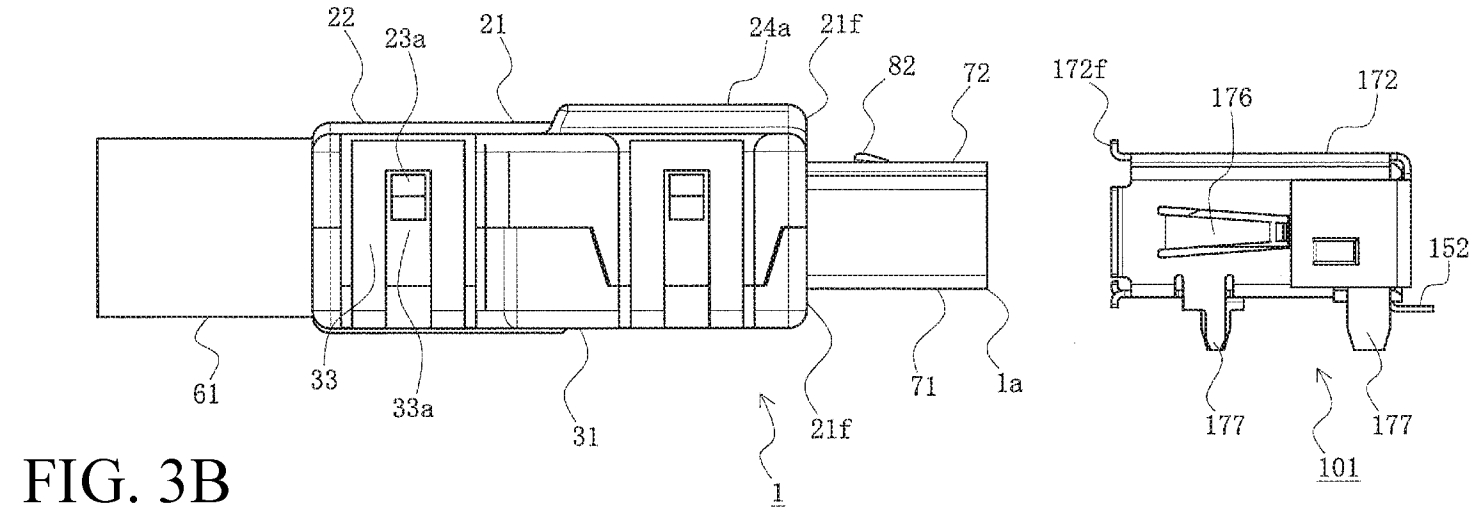
Figure 4:
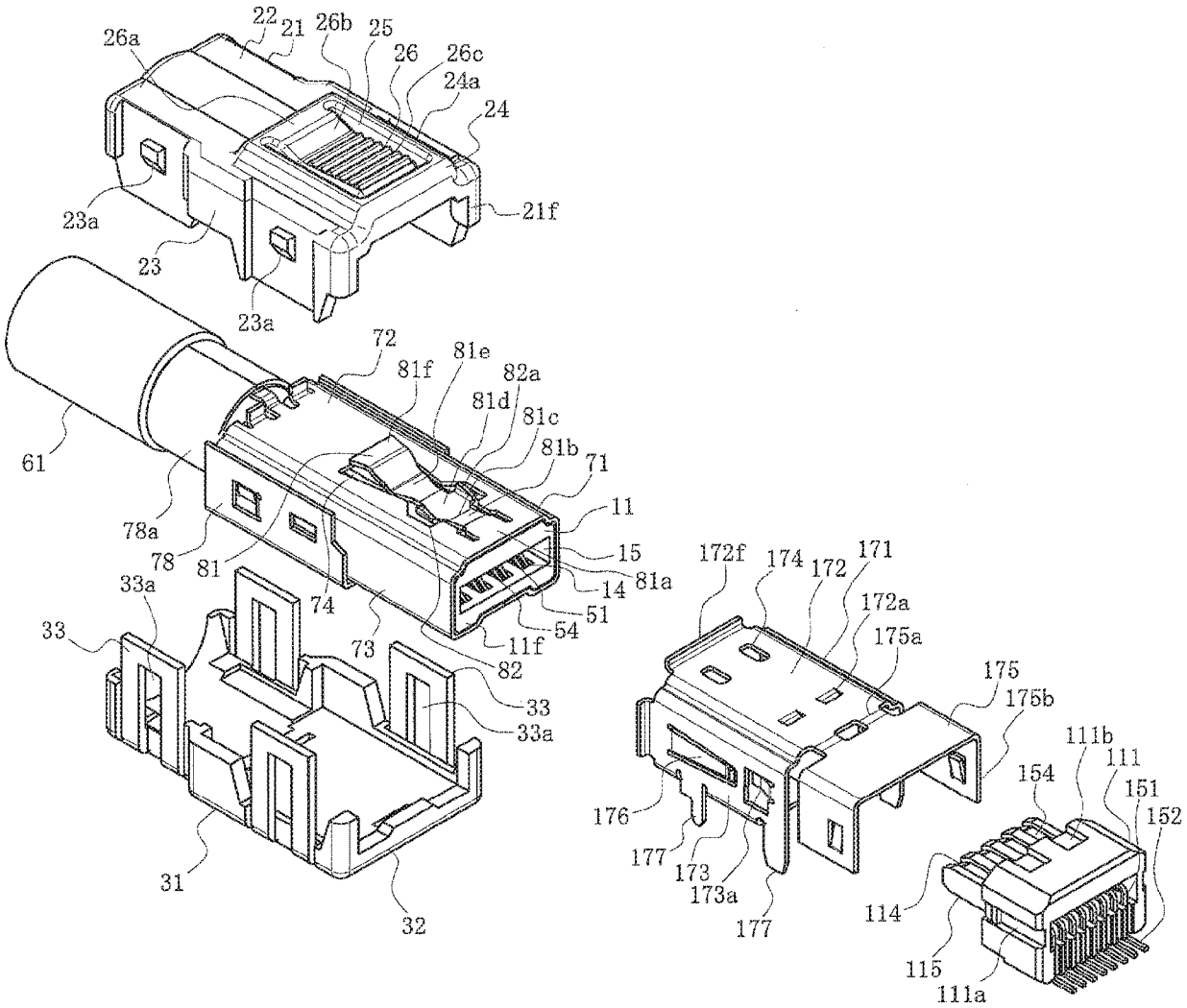
FIG. 4 is an exploded view of the wire connector and the substrate connector according to the present embodiment.

FIG. 1 is a perspective view illustrating the halfway state of mating a wire connector and a substrate connector according to the present embodiment, FIG. 2 is a perspective view illustrating the state prior to mating the wire connector and the substrate connector according to the present embodiment, FIGS. 3A and 3B are two surface views illustrating the state prior to mating the wire connector and the substrate connector according to the present embodiment, and FIG. 4 is an exploded view of the wire connector and the substrate connector according to the present embodiment. Note that FIG. 3A is a plan view, and FIG. 3B is a side view.

In the figure, 1 is a wire connector as a connector according to the present embodiment, which is connected to a terminal of a cable 61 including multiple wires (not illustrated), and is one type of latch connector including a latch mechanism. Moreover, 101 is a substrate connector as a mating connector mating with the wire connector 1 and mounted on a substrate (not illustrated) such as a printed circuit board contained in electrical equipment, electronic equipment, etc. Note that in the present embodiment, the cable 61 is a long narrow member, while in the figure, for convenience, the illustration of the whole cable is omitted, with only the vicinity of the wire connector 1 illustrated.

The wire connector 1 and the substrate connector 101, for example, are used in a variety of electronic equipment such as personal computers, smart phones, along with a variety of equipment such as household equipment, medical equipment, industrial equipment, and transport equipment, but may be used in any application. Here, for convenience of description, the cable 61 includes four pairs of wires, that is, eight wires, having an outer diameter of approximately 8 [mm], with the wire connector 1 having a length of approximately 31 to 32 [mm] along with a width and height of approximately 10 to 13 [mm].

Note that expressions for indicating directions such as up, down, left, right, front, and back, used to describe the operations and configurations of the parts of the wire connector 1 and the substrate connector 101 in the present embodiment are not absolute but rather relative directions, and though appropriate when the parts of the wire connector 1 and the substrate connector 101 are in the positions illustrated in the figures, these directions should be interpreted differently when these positions change, in order to correspond to said change.

The wire connector 1 includes a mating part 1*a* mating with the substrate connector 101. Moreover, the wire connector 1 includes a housing 11 integrally formed of an insulating material such as synthetic resin, along with multiple metal terminals 51 installed in the housing 11. The housing 11 is a box shaped member having a substantially rectangular body that stretches in the width direction of the wire connector 1 and the mating direction with a mating connector 101, that is, the anteroposterior direction of the wire connector 1. Additionally, the housing 11 includes an opening part 15 opened to a front end 11*f* thereof, with multiple terminal housing grooves 14 formed on the upper and lower side walls of the opening part 15. In the example illustrated in the figure, four terminal housing grooves 14 are formed side by side on each of the upper and lower side walls so as to house one terminal 51. Additionally, a contact part 54 of each terminal 51 protrudes from each terminal housing groove 14 towards the inside of the opening part 15. A tail part (not illustrated) of each terminal 51 is electrically connected to corresponding wires of the cable 61. Note that the number of terminal housing grooves 14 and terminals 51 can be optionally changed.

Moreover, the wire connector 1 includes: a shell 71 which is made of a conductive metal plate such as a copper alloy and covers at least a portion of the periphery of the housing 11 in order to EMI (Electro-Magnetic Interference)-shield signals passing therein; and a crimp shell 78 which is made of a conductive metal plate such as a copper alloy and attached outside the shell 71. The crimp shell 78 includes a crimp 78*a* which abuts a shield member (not illustrated) in which the outer coating is removed and exposed in the portion in the vicinity of the terminal of the cable 61 so as to grip the portion. The shell 71 includes: a top plate part 72 covering the upper face of the housing 11; and a side wall part 73 coupled to both side ends of the top plate part 72 so as to cover the right and left side faces of the housing 11.

Further, the wire connector 1 includes: an upper side cover housing 21 as a cover housing that is integrally formed of an insulating material such as a synthetic resin so as to cover the upper side of the portion on the back end side of the shell 71 and the crimp shell 78; and a lower side cover housing 31 as a cover housing that is integrally formed of an insulating material such as a synthetic resin so as to cover the lower side cover housing of the portion on the back end side of the shell 71 and the crimp shell 78. The upper side cover housing 21 includes: a top plate part 22 disposed on the upper side of the top plate part 72 of the shell 71; and a side wall part 23 coupled to both side ends of the top plate part 22. Moreover, the lower side cover housing 31 includes: a bottom plate part 32 disposed on a lower side of the shell 71 and the crimp shell 78; and a coupling leg part 33 extending above both side ends of the bottom plate part 32. Additionally, when a locking opening 33*a*, which is an opening formed in the coupling leg part 33, is locked to a locking protrusion 23*a* protruding from the side wall part 23 of the upper side cover housing 21, the upper side cover housing 21 and the lower side cover housing 31 are coupled to each other so as to cover the peripheral portion on the back-end side of the shell 71 and the crimp shell 78. As illustrated in FIGS. 2 and 3, with the shell 71 covered by the upper side cover housing 21 and the lower side cover housing 31, the shell 71 and the portion on the front end 11*f* side of the housing 11 covered by the shell 71 protrude forward of a cover housing front end 21*f* serving as the front end of the upper side cover housing 21, and function as a mating part 1*a*.

A cantilevered latch member 81, which is a member configuring the latch mechanism, is formed on the top plate part 72 of the shell 71. The latch member 81 is a plate elastic member formed by cutting and raising a portion of the top plate part 72, with a base end 81*a* thereof integrally connected to the top plate part 72. Additionally, the peripheral edge of the latch member 81 excluding the base end 81*a* is cut off from the top plate part 72 by a notched part 74 formed on the top plate part 72 as a result of cutting and raising the latch member 81. The latch member 81 is a long narrow plate spring shaped member that stretches backward from a base end 81*a* thereof, with the base end 81*a* disposed in the vicinity of the front end of the top plate part 72.

Additionally, the latch member 81 includes: a front coupling plate 81*b* which is connected to the tip of the base end 81*a* and inclined so as to descend as the front coupling plate 81*b* travels backward; a wide claw supporting plate 81*d* which is connected to the back end of the front coupling plate 81*b* and inclined so as to ascend as the claw supporting plate 81*d* travels backward; a back coupling plate 81*e* including the portion connected to the back end of the claw supporting plate 81*d* and inclined so as to ascend as the back coupling plate 81*e* travels backward; and a free end 81*f* which is connected to the back end of the back coupling plate 81*e*. Moreover, the latch member 81 includes a pair of latch claws 82 formed by folding upward both the right and left ends of the claw supporting plate 81*d*. Note that in the state with no force applied to the latch member 81, that is, the initial state, the free end 81*f*, and an upper end edge 82*a* of a latch claw 82, are disposed above the upper face of the top plate part 72. Moreover, the connecting part between the front coupling plate 81*b* and the claw supporting plate 81*d* serves as a downward protrusion 81*c* protruding downward and is disposed in the lowermost position in the latch member 81 in the initial state.

A frame part 24 protruding above the top plate part 22 is formed on the top plate part 22 of the upper side cover housing 21, a notched part 25 is formed in the frame part 24, and a latch operating part 26, which is a member configuring the latch mechanism, is housed in the notched part 25. The latch operating part 26 is a plate elastic member integrally formed with the frame part 24, with a base end 26*a* thereof integrally connected to an upper end edge 24*a* of the frame part 24. Additionally, the peripheral edge of the latch operating part 26 excluding the base end 26*a* is cut off from the frame part 24 by the notched part 25 formed on the frame part 24. The latch operating part 26 is a plate spring shaped member stretching forward from the base end 26*a* thereof, with the base end 26*a* disposed in the vicinity of the back end of the frame part 24.

Additionally, the latch operating part 26 includes: a coupling plate 26*b* which is connected to the tip of the base end 26*a* and inclined so as to descend as the coupling plate 26*b* travels forward; and an operation end 26*c* as the free end connected to the front end of the coupling plate 26*b*. The operation end 26*c* is the portion that an operator operates by finger and therefore, as illustrated in the figure, anti-slipping recesses and protrusions are desirably formed on the upper face. Additionally, as illustrated in FIG. 2, with the shell 71 covered by the upper side cover housing 21 and the lower side cover housing 31, the operation end 26*c* is disposed just above the free end 81*f* of the latch member 81; and thereby, when an operator presses down the operation end 26*c* by finger, the free end 81*f* of the latch member 81 is pressed down. Moreover, in the example illustrated in the figure, the latch operating part 26 is formed such that the whole thereof does not protrude above the upper end edge 24*a* of the frame part 24.

In contrast, the substrate connector 101 includes: a mating housing 111 which is integrally formed of an insulating material such as a synthetic resin and mates with the wire connector 1; and multiple metal mating terminals 151 installed in the mating housing 111. The mating housing 111 is a box shaped member having a substantially rectangular body that stretches in the width direction of the substrate connector 11 and the mating direction of the wire connector 1, that is, the anteroposterior direction of the substrate connector 101. Additionally, the mating housing 111 includes a tongue shaped part 115 protruding forward, with multiple terminal housing grooves 114 formed on the upper and lower faces of the tongue shaped part 115. In the example illustrated in the figure, four terminal housing grooves 114 are formed side by side on each of the upper and lower faces so as to house one contact part 154 of a mating terminal 151. In the example illustrated in the figure, tail parts 152 of the mating terminal 151 are provided in one-line side by side in the width direction of the substrate connector 101 and are electrically connected to a connection pad on the surface of a substrate (not illustrated) by means such as soldering. Note that the number of terminal housing grooves 114 and mating terminals 151 can be optionally changed.

Moreover, the substrate connector 101 includes a mating shell 171 which is made of a conductive metal plate such as a copper alloy and covers the periphery of the mating housing 111 in order to EMI-shield signals passing therein. The mating shell 171 includes: a top plate part 172 covering the upper face of the mating housing 111; a side wall part 173 coupled to both side ends of the top plate part 172 so as to cover the right and left side faces of the mating housing 111; and a back-wall part 175 connected to the back end of the top plate part 172 via a folding part 175*a*. Note that at least a front end 172*f* of the top plate part 172 is desirably curved gently upward.

A pair of cut-raised pieces 172*a* which enter a pair of upper face recesses 111*b* formed on the upper face of the mating housing 111 so as to hold the mating housing 111, and a pair of locking holes 174 into which a pair of latch claws 82 of the latch member 81 of the wire connector 1 is inserted and locked, are formed on the top plate part 172, with the mating shell 171 attached to the mating housing 111. Moreover, a cut-raised piece 173*a* for entering a side face recess 111*a* formed on the side face of the mating housing 111 so as to hold the mating housing 111, along with a pressed cut-raised piece 176 that presses the side wall part 73 of the shell 71 of the wire connector 1 from the right and left so as to hold the shell 71, are formed on the side wall part 173, with the mating shell 171 attached to the mating housing 111. Further, the side wall part 173 includes multiple (four in the example illustrated in the figure) attaching legs 177 that extend downward from the lower end thereof. The attaching leg 177 is inserted and fixed into an attaching hole formed in the substrate (not illustrated), whereby the substrate connector 101 is assuredly fixed to the substrate.

Note that the folding part 175*a* is folded at nearly 90°. As a result, the back face of the mating housing 111, as illustrated in FIG. 2, is covered over by the back-wall part 175. Note that an auxiliary side wall 175*b* connected to both side ends of the back-wall part 175 is overlapped by the portion in the vicinity of the back end of the side wall part 173.

Next, the operation of the wire connector 1 will be described. First, the operation of mating the wire connector 1 with the substrate connector 101 will be described.

Figure 5:
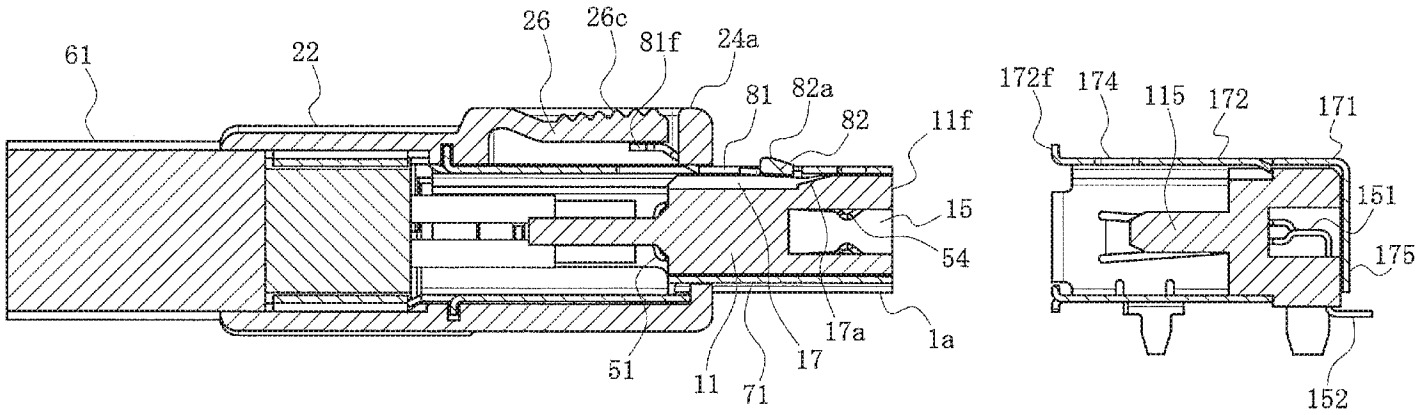
FIG. 5 is a longitudinal cross-sectional view illustrating the state prior to mating the wire connector and the substrate connector according to the present embodiment, and corresponding to the arrow cross-section along line A-A in FIG. 3A.
Figure 6:
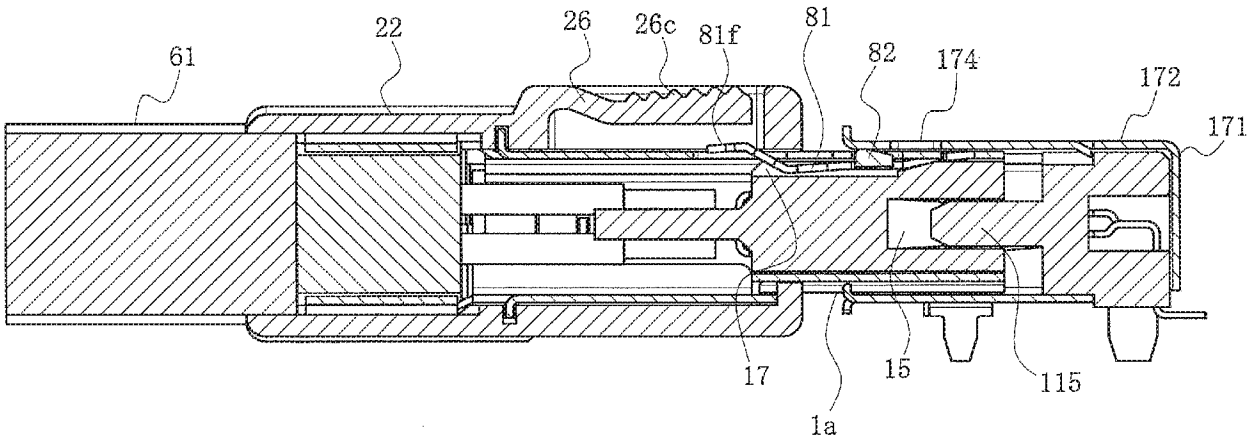
FIG. 6 is a longitudinal cross-sectional view illustrating the halfway state of mating the wire connector and the substrate connector according to the present embodiment, and corresponding to the arrow cross-section along line A-A in FIG. 3A.
Figure 7:
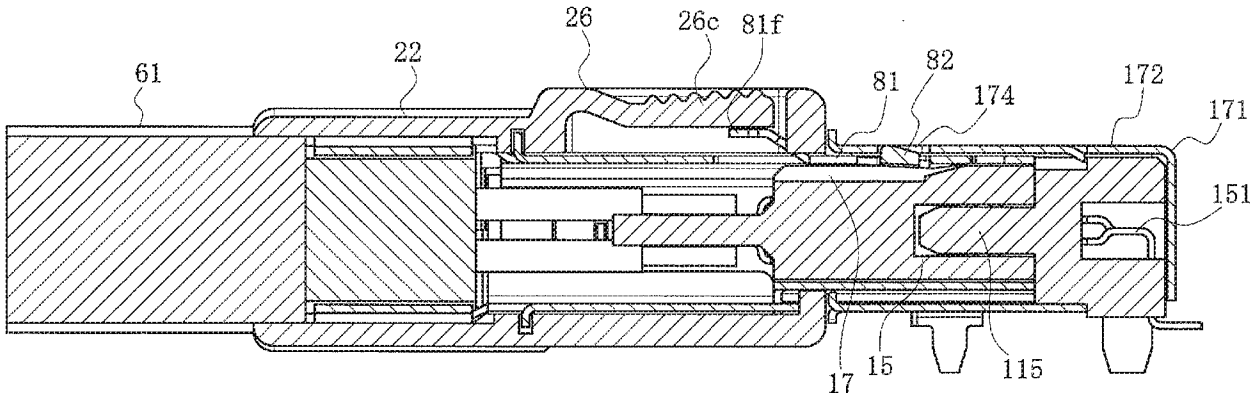
FIG. 7 is a longitudinal cross-sectional view illustrating the state of having mated the wire connector and the substrate connector according to the present embodiment, and corresponding to the arrow cross-section along line A-A in FIG. 3A.
Figure 8A:
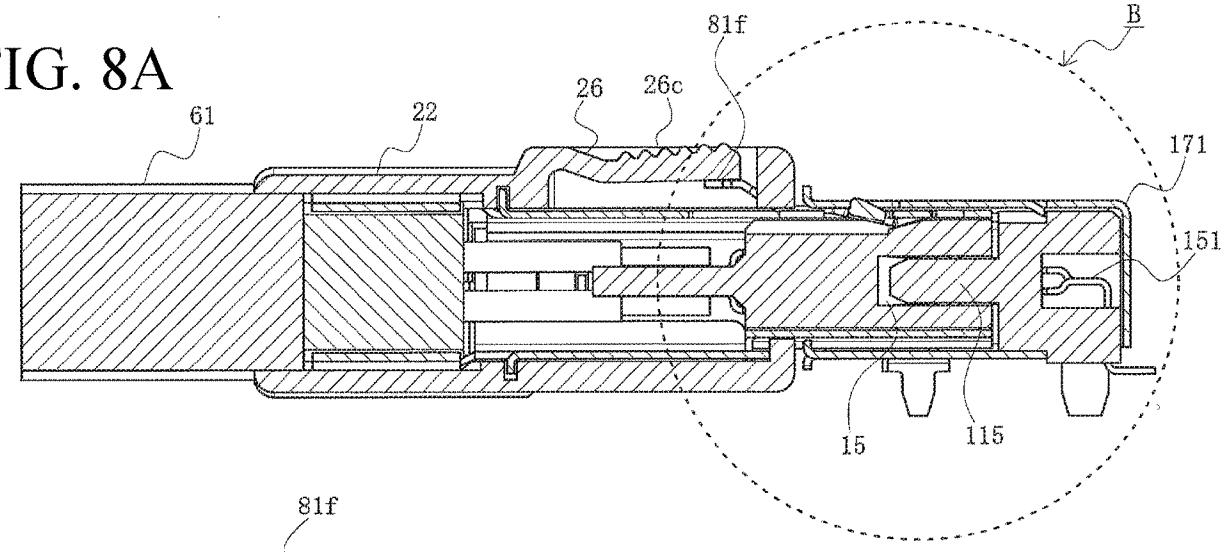
Figure 8B:
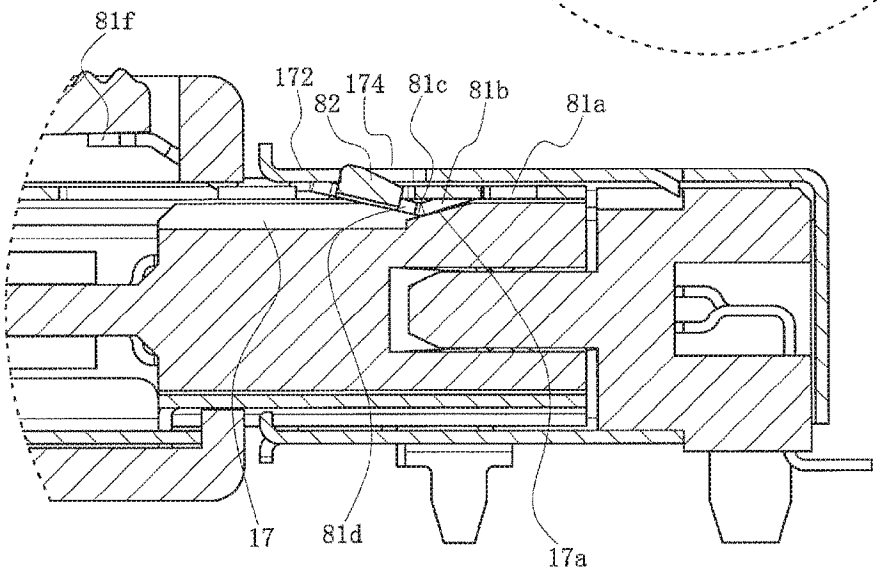

FIG. 5 is a longitudinal cross-sectional view illustrating the state prior to mating the wire connector and the substrate connector according to the present embodiment, FIG. 6 is a longitudinal cross-sectional view illustrating the halfway state of mating the wire connector and the substrate connector according to the present embodiment, FIG. 7 is a longitudinal cross-sectional view illustrating the state of having mated the wire connector and the substrate connector according to the present embodiment, and FIGS. 8A and 8B are longitudinal cross-sectional views illustrating the state of forcibly extracting the wire connector from the substrate connector according to the present embodiment. Note that FIG. 8A is a longitudinal cross-sectional view, and FIG. 8B is an enlarged view of the portion B of FIG. 8A. Moreover, FIGS. 5 to 8B are views each illustrating a longitudinal cross-section corresponding to the arrow cross-section along the line A-A in FIG. 3A.

First, an operator, as illustrated in FIGS. 2, 3A, 3B, and 5, opposes the wire connector 1 to the substrate connector 101 mounted on the substrate. That is, the front end 11*f* of the housing 11 is opposite the tongue shaped part 115 of the mating housing 111 housed in the cavity of the mating shell 171. As illustrated in FIG. 5, because a latch member housing recess 17 is formed on the portion opposite the latch member 81 on the upper face of the housing 11, the latch member 81 can be displaced below the initial state without abutting the upper face of the housing 11. Note that upon forcibly extracting the wire connector 1, in order to prevent the downward protrusion 81*c* of the latch member 81 from being excessively displaced downward, that is, in order to limit the downward displacement of the downward protrusion 81*c*, a displacement preventing protrusion 17*a* protruding upward from the bottom face of the latch member housing recess 17 is formed on the front end portion of the latch member housing recess 17.

Additionally, the wire connector 1 is moved so as to approach the 101, and as illustrated in FIG. 6, the mating part 1*a* is inserted into the cavity of the mating shell 171, with the tongue shaped part 115 of the mating housing 111 relatively inserted into the opening part 15 of the housing 11. In this case, the front end 172*f* of the top plate part 172 is curved gently upward, while the upper end edge 82*a* of the latch claw 82 protruding above the top plate part 72 of the shell 71 is inclined in the downward direction of the front end 11*f* of the housing 11. That is, because it is inclined forwardly downward, even when an operator presses down the operation end 26*c* of the latch operating part 26 but does not press down the free end 81*f* of the latch member 81, the latch claw 82 travels with the upper end edge 82*a* thereof in slide contact with the front end 172*f* of the top plate part 172 and is thereby smoothly pressed down. Moreover, in the latch member 81, which is a cantilevered plate spring, the base end 81*a* fixed to the top plate part 72 of the shell 71 is disposed on the front side in the traveling direction to the mating shell 171, that is, the leading side, while the latch claw 82 is disposed on the back side in the traveling direction of the base end 81*a*, that is, the trailing side, thereby allowing the latch member 81 to be smoothly pressed down. Note that the portion pressed down in the latch member 81 is housed in the latch member housing recess 17.

Subsequently, when the wire connector 1 is further moved, as illustrated in FIG. 7, the cover housing front end 21*f* abuts or is adjacent to the front end 172*f* of the top plate part 172 of the mating shell 171, leading to the completion of the mating between the wire connector 1 and the substrate connector 101. As a result, overall the tongue shaped part 115 of the mating housing 111 is inserted into the opening part 15 of the housing 11, while the contact part 54 of each terminal 51 contacts a corresponding contact part 154 of the mating terminal 151 so as to be conductive. Moreover, the shell 71 is pressed and held from the right and left by the pressed cut-raised piece 176 of the mating shell 171. Further, the latch claw 82, which is energized upward by the spring force of the latch member 81 being pressed down, enters a locking hole 174 of the top plate part 172 of the mating shell 171 so as to be locked. As a result, the shell 71 of the wire connector 1 is latched by the mating shell 171 of the substrate connector 101, preventing the wire connector 1 from being separated from the substrate connector 101 and releasing the mating.

If great tensile strength is added to the wire connector 1 without carrying out the regular operation for releasing the mating, as illustrated in FIGS. 8A and 8B, the mating part 1*a* is slightly detached from the substrate connector 101, so as to generate a gap between the cover housing front end 21*f* and the front end 172*f* of the top plate part 172 of the mating shell 171. However, in the present embodiment, because the state of the latch claw 82 being locked to the locking hole 174 is maintained, the latch is not released, and thereby, the wire connector 1 is assuredly prevented from being separated from the substrate connector 101 and releasing the mating.

More specifically, for the case in which tensile strength is added to the wire connector 1 without carrying out the operation of displacing downward the free end 81*f* of the latch member 81, when the back end edge of the latch claw 82 is locked to the front end edge of the locking hole 174, as illustrated in FIG. 7, the back end edge of the latch claw 82 stretches in the direction orthogonal to the direction in which the top plate part 172 of the mating shell 171 stretches and is disposed on the front side in the tensile direction of the base end 81*a* of the cantilevered latch member 81, that is, the leading side, such that resistance force to the displacement in the tensile direction is great. Accordingly, the back-end edge of the latch claw 82 does not release the front-end edge of the locking hole 174.

Moreover, when the back-end edge of the latch claw 82 receives force from the front-end edge of the locking hole 174 so as to generate a moment, the latch claw 82, together with the claw supporting plate 81*d*, is rotated in the clockwise direction in FIG. 8B, while the downward protrusion 81*c* is displaced downward but abutting the displacement preventing protrusion 17*a* so as not to be displaced excessively downward. Accordingly, because the rotation of the latch claw 82 in the clockwise direction in FIG. 8B is suppressed, the back-end edge of the latch claw 82 does not release the front-end edge of the locking hole 174.

Further, as illustrated in FIG. 3A, because the latch member 81 is formed so as to be wide in the approximate center in the width direction of the top plate part 72, giving it high rigidity, with the claw supporting plate 81*d* with the latch claw 82 formed therein being the widest portion, thereby giving it higher rigidity, and further, because force is equally transmitted from a pair of right and left latch claws 82, deformations such as twisting tend not to occur. Accordingly, the back-end edge of the latch claw 82 does not release the front end edge of the locking hole 174.

Next, the operation of releasing the mating between the wire connector 1 and the substrate connector 101 will be described.

Figure 9:
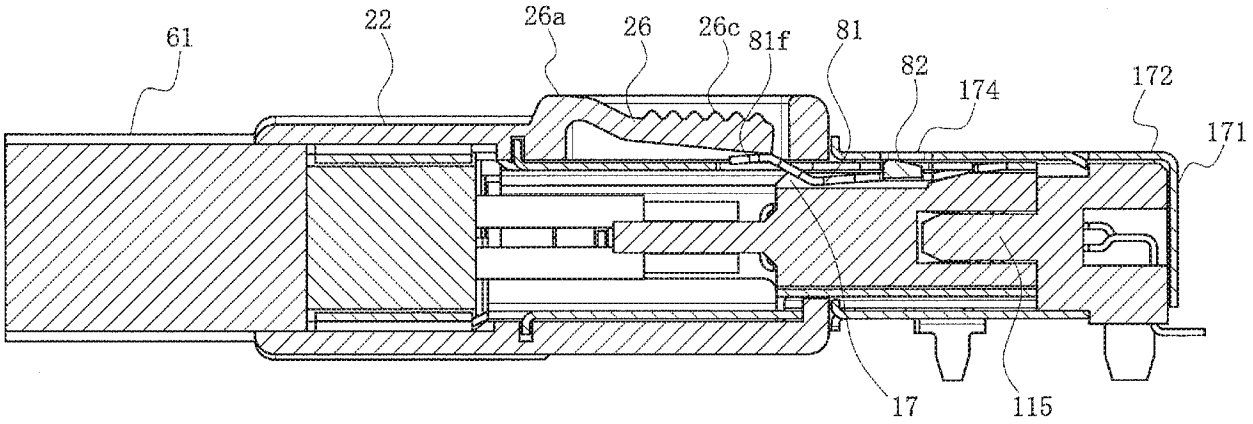
FIG. 9 is a longitudinal cross-sectional view illustrating the state of having started the operation of releasing the mating between the wire connector and the substrate connector according to the present embodiment, and corresponding to the arrow cross-section along line A-A in FIG. 3A.
Figure 10:
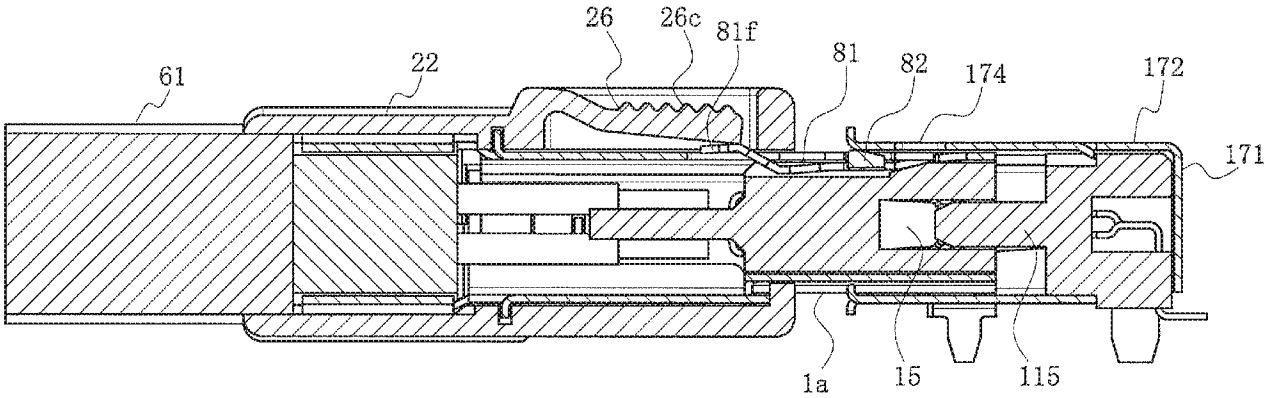
FIG. 10 is a longitudinal cross-sectional view illustrating the halfway state of releasing the mating between the wire connector and the substrate connector according to the present embodiment, and corresponding to the arrow cross-section along line A-A in FIG. 3A.
Figure 11:
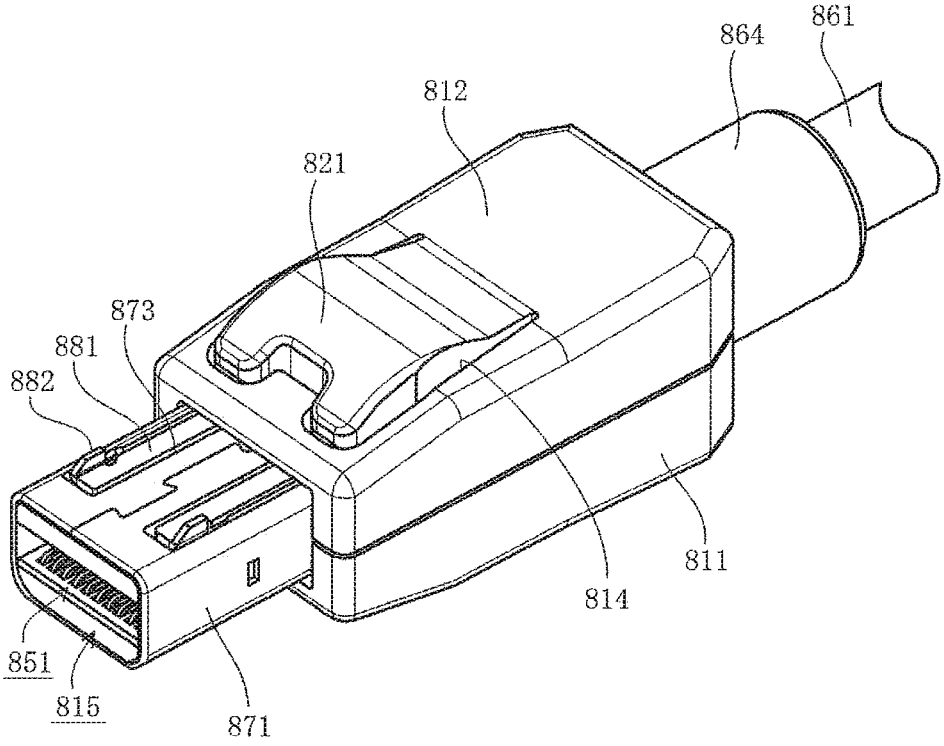
FIG. 11 Prior Art
FIG. 11 is a view illustrating a conventional latch connector.

FIG. 9 is a longitudinal cross-sectional view illustrating the state of having started the operation of releasing the mating between the wire connector and the substrate connector according to the present embodiment, and FIG. 10 is a longitudinal cross-sectional view illustrating the halfway state of releasing the mating between the wire connector and the substrate connector according to the present embodiment. Note that FIGS. 9 and 10 are views each illustrating a longitudinal cross-section corresponding to the arrow cross-section along line A-A in FIG. 3A.

First, when an operator presses down the operation end 26*c* of the latch operating part 26, the free end 81*f* of the latch member 81 is pressed down. Then, the latch claw 82 is also displaced downward such that the upper end edge 82*a* of the latch claw 82 is below the top plate part 172 of the mating shell 171. That is, the latch claw 82 moves outside the locking hole 174 to release the locking. As a result, the latch between the shell 71 of wire connector 1 and the mating shell 171 of the substrate connector 101 is released and the wire connector 1 is separated from the substrate connector 101, enabling the mating to be released.

Note that the latch operating part 26 is formed such that the whole thereof is surrounded by the frame part 24 so as not to protrude above the upper end edge 24*a*. Accordingly, even when an operator touches each portion of the wire connector 1 and the substrate connector 101 by finger, the operator does not mistakenly press down the operation end 26*c* of the latch operating part 26. That is, the operation end 26*c* is not pressed down by an erroneous operation.

Subsequently, when the operator presses down the operation end 26*c* and pulls the wire connector 1, moving it backward, that is, moving it in the direction away from the substrate connector 101 while maintaining the state in which the locking between the latch claw 82 and the locking hole 174 is released, as illustrated in FIG. 10, the mating part 1*a* recedes from inside the cavity of the mating shell 171 and the tongue shaped part 115 of the mating housing 111 relatively recedes from inside the opening part 15 of the housing 11.

Subsequently, when the wire connector 1 is further moved backward, releasing of the mating between the wire connector 1 and the substrate connector 101 is completed, with the wire connector 1 detached from the substrate connector 101.

As described above, in the present embodiment, the wire connector 1 includes the housing 11, terminals 51 installed in the housing 11, and the shell 71 covering at least a portion of the housing 11. Additionally, the top plate part 72 of the shell 71 includes the cantilevered latch member 81, which is a single plate spring shaped latch member 81 formed by cutting and raising the central part in the width direction of the top plate part 72, and the latch member 81 includes a pair of latch claws 82 formed by folding both the right and left ends of the latch member 81.

As a result, because the latch member 81 has high rigidity and force is equally transmitted from a pair of right and left latch claws 82, deformations such as twisting tend not to occur, allowing latching strength to be increased without enlarging the dimensions such that even when unexpected external force is added, the latch is not released.

Moreover, the latch member 81 includes: the base end 81*a* integrally connected to the top plate part 72; the free end 81*f* disposed behind the base end 81*a*; and the wide claw supporting plate 81*d* disposed between the base end 81*a* and the free end 81*f*, wherein the latch claw 82 is formed on both the right and left ends of the claw supporting plate 81*d*. Accordingly, even when unexpected external force is added, because the latch claw 82 is disposed on the leading side of the base end 81*a* of the latch member 81, the resistance force is great, the claw supporting plate 81*d* with the latch claw 82 formed therein is wide and therefore has high rigidity, and the latch is not released.

In addition, the latch member 81 further includes the front coupling plate 81*b* which is connected to the base end 81*a* and inclined so as to descend as the front coupling plate 81*b* travels backward, the claw supporting plate 81*d* is inclined so as to descend as the claw supporting plate 81*d* travels forward, and the claw supporting plate 81*d* is connected to the front coupling plate 81*b* in the downward protrusion 81*c* protruding downward, while the housing 11 includes the latch member housing recess 17 formed in the portion opposite the latch member 81, the displacement preventing protrusion 17*a* protruding upward is formed on the bottom face of the latch member housing recess 17, and the displacement preventing protrusion 17*a* limits the downward displacement of the downward protrusion 81*c*. As a result, the downward protrusion 81*c* is not excessively displaced downward, and the rotation of the latch claw 82 is suppressed.

Further, the wire connector 1 further includes the upper side cover housing 21 covering at least a portion of the top plate part 72 of the shell 71. Additionally, the upper side cover housing 21 has the operation end 26*c* that can be displaced in the vertical direction and includes the latch operating part 26 disposed just above the free end 81*f* of the latch member 81, while the periphery of the latch operating part 26 is surrounded by the frame part 24 and does not protrude above the upper end edge 24*a* of the frame part 24. As a result, the operation end 26*c* is not pressed down by an erroneous operation of the operator and the latch is not released.

Additionally, the wire connector 1 further includes the mating part 1*a* mating with the substrate connector 101. Additionally, the latch claw 82 is disposed on the mating part 1*a*, wherein, when mating with the substrate connector 101 is completed, the latch claw 82 enters the locking hole 174 formed in the mating shell 171 of the substrate connector 101 so as to be locked, wherein, when force to release the mating without carrying out the operation of displacing the free end 81*f* downward is applied to the mating part 1*a*, the downward protrusion 81*c* abuts the displacement preventing protrusion 17*a* so as to limit the downward displacement, thereby preventing the locking between the latch claw 82 and the locking hole 174 from being released. Accordingly, the wire connector 1 can be assuredly prevented from being separated from the substrate connector 101 and releasing the mating.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

What is claimed is:

1. A connector, comprising:

a housing;

a terminal installed in the housing; and a shell covering at least a portion of the housing, wherein a top plate part of the shell includes a cantilevered latch member, which is a plate spring shaped single latch member formed by cut-raising a central part in the width direction of the top plate part, and wherein the latch member includes a pair of latch claws formed by folding both right and left sides of the latch member, wherein the latch member includes: a base end integrally connected to the top plate part;

a free end disposed behind the base end; and a claw supporting plate disposed between the base end and the free end, wherein the pair of latch claws is formed on both right and left sides, respectively, of the claw supporting plate.

2. The connector according to claim 1, further comprising a cover housing covering at least a portion of the top plate part of the shell, wherein the cover housing has a free end that can be displaced in a vertical direction and includes a latch operating part disposed just above the free end of the latch member, and wherein the periphery of the latch operating part is surrounded by a frame part and does not protrude above an upper end edge of the frame part.

3. A connector, comprising:

a housing;

a terminal installed in the housing; and a shell covering at least a portion of the housing, wherein a top plate part of the shell includes a cantilevered latch member, which is a plate spring shaped single latch member formed by cut-raising a central part in the width direction of the top plate part, and wherein the latch member includes a pair of latch claws formed by folding both right and left sides of the latch member, wherein the latch member includes: a base end integrally connected to the top plate part; a front coupling plate connected to the base end and inclined so as to descend as the front coupling plate travels backward; and a claw supporting plate connected to the front coupling plate, wherein the pair of latch claws is formed on both right and left sides, respectively, of the claw supporting plate, wherein the claw supporting plate is inclined so as to descend as the claw supporting plate travels forward, and the claw supporting plate is connected to the front coupling plate in a downward protrusion protruding downward, and the housing includes a latch member housing recess formed in a portion opposite the latch member, a displacement preventing protrusion protruding upward is formed on a bottom face of the latch member housing recess, and the displacement preventing protrusion limits the downward displacement of the downward protrusion.

4. The connector according to claim 3, further comprising a mating part mating with a mating connector, wherein the pair of latch claws is disposed on the mating part, wherein, when mating with the mating connector is completed, each latch claw enters a respective locking hole formed in a mating shell of the mating connector so as to be locked, wherein, when force to release the mating without carrying out the operation of displacing downward the free end is applied to the mating part, the downward protrusion abuts the displacement preventing protrusion so as to limit the downward displacement, thereby preventing the locking between the latch claws and the locking holes from being released.

5. A connector, comprising:

a housing;

a terminal installed in the housing; and a shell covering at least a portion of the housing, the shell having a top plate part, the top plate part having a front end, a rear end and a latch member positioned between the front and rear ends, wherein the latch member is formed from the top plate part and has a pair of latch claws which are formed by folding right and left sides of the latch member, whereby, in an initial state, each latch claw has an upper end edge that is disposed above an upper face of the top plate part.

6. The connector according to claim 5, wherein in the latch member is cantilevered.

7. The connector according to claim 6, wherein the latch member has a base end, a free end and a claw supporting plate, wherein the base end is integrally connected to the top plate part, wherein the claw supporting plate is disposed between the base end and the free end, wherein the pair of latch claws is formed on both right and left sides, respectively, of the claw supporting plate.

8. The connector according to claim 7, wherein in the initial state, the free end is disposed above the upper face of the top plate part.

9. The connector according to claim 7, wherein the base end is positioned proximate to the front end of the top plate part as compared to the free end, and wherein the free end is positioned proximate to the rear end of the top plate part as compared to the base end.

10. The connector according to claim 7, wherein the latch member further has a front coupling plate, the front coupling plate having a front end and a rear end, the front end of the front coupling plate being connected to the base end, the rear end of the front coupling plate being connected to the claw supporting plate.

11. The connector according to claim 10, wherein a portion of the latch member provided where the rear end of the front coupling plate is connected to the claw supporting plate serves as a downward protrusion that protrudes downward and, in the initial state, is disposed as a lowermost portion of the latch member.

12. The connector according to claim 11, wherein the housing has an upper face which defines a recess which is positioned opposite the latch member, the recess allows the latch member to be displaced below the initial state without abutting the upper face of the housing.

13. The connector according to claim 12, wherein the housing has a protrusion which limits downward displacement of the downward protrusion.

14. The connector according to claim 10, wherein the latch member further has a back coupling plate, the back coupling plate having a front end and a rear end, the front end of the back coupling plate being connected to the claw supporting plate, the rear end of the back coupling plate being connected to the free end.

15. The connector according to claim 7, wherein a peripheral edge of the latch member, excluding the base end, is cut off from the top plate part by a notched part formed on the top plate part.

16. The connector according to claim 7, further comprising an upper side cover housing which covers an upper side of a rear end portion of the shell.

17. The connector according to claim 16, further comprising a lower side cover housing which covers a lower side of the rear end portion of the shell.

18. The connector according to claim 16, wherein the upper side cover housing has a latch operating part, the latch operating part having an operation end which is disposed above the free end of the latch member, whereby downward movement of the operation end of the latch operating part causes the free end of the latch member to move downward.

19. The connector according to claim 5, further comprising a crimp shell which is attached to an exterior of the shell.

* * * * *